US009509077B2

(12) United States Patent
Iihoshi et al.

(10) Patent No.: US 9,509,077 B2
(45) Date of Patent: Nov. 29, 2016

(54) CONNECTOR WITH LOCKING LANCE AND TERMINAL FITTING WITH DEFLECTION REGULATING PORTION FOR REGULATING DEFLECTION OF THE LOCKING LANCE

(71) Applicant: Sumitomo Wiring Systems, Ltd., Yokkaichi, Mie (JP)

(72) Inventors: Shinji Iihoshi, Mie (JP); Keita Nakashima, Mie (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 14/782,332

(22) PCT Filed: Dec. 4, 2013

(86) PCT No.: PCT/JP2013/082633
§ 371 (c)(1),
(2) Date: Oct. 5, 2015

(87) PCT Pub. No.: WO2015/083258
PCT Pub. Date: Jun. 11, 2015

(65) Prior Publication Data

US 2016/0164212 A1 Jun. 9, 2016

(30) Foreign Application Priority Data

Apr. 26, 2013 (JP) ..... 2013-093994

(51) Int. Cl.
*H01R 13/428* (2006.01)
*H01R 13/422* (2006.01)

(52) U.S. Cl.
CPC ..... *H01R 13/4223* (2013.01)

(58) Field of Classification Search
USPC ..... 439/595, 871
See application file for complete search history.

(56) References Cited

U.S. PATENT DOCUMENTS 6,702,614 B2 * 3/2004 Nakamura ..... H01R 13/4223 439/595
6,796,837 B2 9/2004 Fukatsu et al.
(Continued)

FOREIGN PATENT DOCUMENTS

JP 2003-257532 9/2003
JP 2004-39279 2/2004
(Continued)

OTHER PUBLICATIONS

International Search Report.

*Primary Examiner* — Tho D Ta
(74) *Attorney, Agent, or Firm* — Gerald E. Hespos; Michael J. Porco; Matthew T. Hespos

(57) ABSTRACT

A connector includes a pressure receiving surface (16) on a front of a locking lance (12) and a lock (36) on a terminal (30) is configured to lock the pressure receiving surface (16). An inclined surface (15) on a facing surface (13) of the locking lance (12) faces the terminal (30) and is inclined to be more separated from the terminal fitting (30) toward the back. A guiding surface (18) on the pressure receiving surface (16) is configured to deflect the locking lance (12) toward the terminal (30) when the lock (36) presses the pressure receiving surface (16). A contact surface (21) behind the pressure receiving surface (16) on the locking lance (12) faces the terminal (30). A deflection regulating portion (38) behind the lock (36) on the terminal (30) faces the contact surface (21) while being spaced apart parallel to a resilient deflecting direction of the locking lance (12).

6 Claims, 8 Drawing Sheets

(56) References Cited

U.S. PATENT DOCUMENTS

| | | | | |
|---|---|---|---|---|
| 7,374,465 | B2 * | 5/2008 | Tanaka | H01R 13/113 439/595 |
| 2009/0124114 | A1 | 5/2009 | Ishikawa | |

FOREIGN PATENT DOCUMENTS

| | | |
|---|---|---|
| JP | 2006-236678 | 9/2006 |
| JP | 2009-123373 | 6/2009 |
| JP | 2012-216344 | 11/2012 |

* cited by examiner

CONNECTOR WITH LOCKING LANCE AND TERMINAL FITTING WITH DEFLECTION REGULATING PORTION FOR REGULATING DEFLECTION OF THE LOCKING LANCE

BACKGROUND

1. Field of the Invention

This invention relates to a connector.

2. Description of the Related Art

Japanese Unexamined Patent Publication No. 2004-039279 discloses a connector designed to improve the reliability of a holding function of retaining a terminal fitting inserted into a terminal accommodating chamber of a housing by a locking action of a locking lance. The terminal fitting is inserted into the terminal accommodating chamber from behind and the locking lance is cantilevered forward along an inner wall of the terminal accommodating chamber. In this connector, if a backward tensile force acts on the terminal fitting retained by being locked by the locking lance, a thin part of the locking lance is bent to shorten a length along an extending direction of the locking lance. By shortening the extending length of the locking lance, the buckling strength of the locking lance is enhanced and, consequently, a holding force of the locking lance is enhanced.

In the above connector, the locking lance is locked to the terminal fitting at an extending end surface thereof. Thus, even if the locking lance becomes shorter, the locking lance may buckle and the holding force by the locking lance may be lost if a tensile force acting on the locking lance becomes strong.

The invention was completed based on the above situation and aims to improve the reliability of a function of holding a terminal fitting by a locking lance.

SUMMARY

The invention is directed to a connector, including a housing internally formed with a terminal accommodating chamber for receiving a terminal fitting inserted into the terminal accommodating chamber from behind. A locking lance made of synthetic resin is cantilevered forward along an inner wall of the terminal accommodating chamber and is configured to be deflected resiliently in a direction intersecting an inserting direction in the process of inserting the terminal fitting into the terminal accommodating chamber. However, the locking lance will return resiliently to a free state when the terminal fitting is inserted properly into the terminal accommodating chamber. A pressure receiving surface is formed on a front end surface of the locking lance. A locking portion is formed on the terminal fitting and is configured to retain the terminal fitting by locking the pressure receiving surface from the front. An inclined surface is formed on a facing surface of the locking lance facing the terminal fitting and is inclined to be more separated from the terminal fitting toward the back. A guiding surface is formed on at least one of the pressure receiving surface and the locking portion and is configured to deflect the locking lance in a direction toward the terminal fitting when the locking portion presses the pressure receiving surface. A contact surface is formed at a position of the locking lance behind the pressure receiving surface and faces the terminal fitting. A deflection regulating portion is formed at a position of the terminal fitting behind the locking portion and is configured to face the contact surface while being spaced apart in a direction substantially parallel to a resilient deflecting direction of the locking lance when the locking lance is in the free state free from resilient deflection.

When the locking portion comes into contact with the pressure receiving surface from the front, a shear force is created in the locking lance along a virtual surface extending from a contact position to the inclined surface in parallel to a tensile direction of the terminal fitting. In the present invention, a cross-section when the locking lance is virtually cut along this virtual surface is defined as a "shear cross-section" and a cross-sectional area of this horizontal shear cross-section is defined as a "shear area".

When the terminal fitting is inserted properly into the terminal accommodating chamber, the locking portion locks the pressure receiving surface on the front end of the locking lance that has returned resiliently to the free state and the terminal fitting is retained by this locking action. If a backward tensile force acts on the terminal fitting, the locking portion presses the pressure receiving surface. Thus, the locking lance is deflected in the direction toward the terminal fitting by the guiding surface. As the locking lance is deflected in the direction toward the terminal fitting, the shear cross-sectional area becomes larger. Thus, a force of holding the terminal fitting by the locking lance is enhanced.

The contact surface comes into contact with the deflection regulating portion when the locking lance is deflected to a predetermined position and any further deflection of the locking lance is regulated. This contact surface and the deflection regulating portion are arranged behind the contact position of the locking portion and the pressure receiving surface, i.e. at a position closer to a base end than the front end of the locking lance. Thus, even if the locking lance is going to buckle and deform between the base end and the front end, the buckling of the locking lance is prevented by the contact of the deflection regulating portion and the contact surface. There is no possibility of losing the holding force by the locking lance due to the buckling deformation of the locking lance according to the invention. Thus, the reliability of a function of holding the terminal fitting by the locking lance is excellent.

The connector may include a stopper formed on the locking lance and configured to regulate a backward relative displacement of the terminal fitting with respect to the locking lance by the contact of the deflection regulating portion therewith from the front when the locking portion bites into the pressure receiving surface. Accordingly, when the locking portion bites into the pressure receiving surface, the deflection regulating portion contacts the stopper to regulate a backward relative displacement of the terminal fitting with respect to the locking lance. Thus, excessive biting of the locking portion into the pressure receiving surface is prevented.

The connector may include a cut portion recessed from the facing surface of the locking lance facing the terminal fitting and configured so that a surface of a recessed region facing the terminal fitting serves as the contact surface.

A locking margin between the locking portion and the pressure receiving surface in the resilient deflecting direction of the locking lance is equivalent to a distance from the facing surface of the locking lance facing the terminal fitting to the locking portion. If the contact surface is set on the facing surface of the locking lance facing the terminal fitting, a height difference between the deflection regulating portion and the locking portion is large. This complicates the shape of the terminal fitting. However, the contact surface of the invention is arranged in the cut portion formed by recessing the facing surface of the locking lance facing the terminal fitting. Therefore the shape of the terminal fitting can be simplified by reducing the height difference between the deflection regulating portion and the locking portion.

Two of the contact surfaces and two of the deflection regulating portions are provided bilaterally symmetrically in a width direction intersecting both the resilient deflecting direction of the terminal fitting and the inserting direction of the locking lance. Accordingly, the posture of the locking lance is not laterally inclined when the contact surfaces contact the deflection regulating portions. Thus, the function of holding the terminal fitting by the locking lance is stabilized.

Two of the deflection regulating portions and two of the stoppers may be provided bilaterally symmetrically in a width direction intersecting both the resilient deflecting direction of the terminal fitting and the inserting direction of the locking lance. Accordingly, the posture of the locking lance is not changed laterally when the deflection regulating portions contact the stoppers. Therefore, the function of holding the terminal fitting by the locking lance is stabilized.

DETAILED DESCRIPTION

Figure 1:
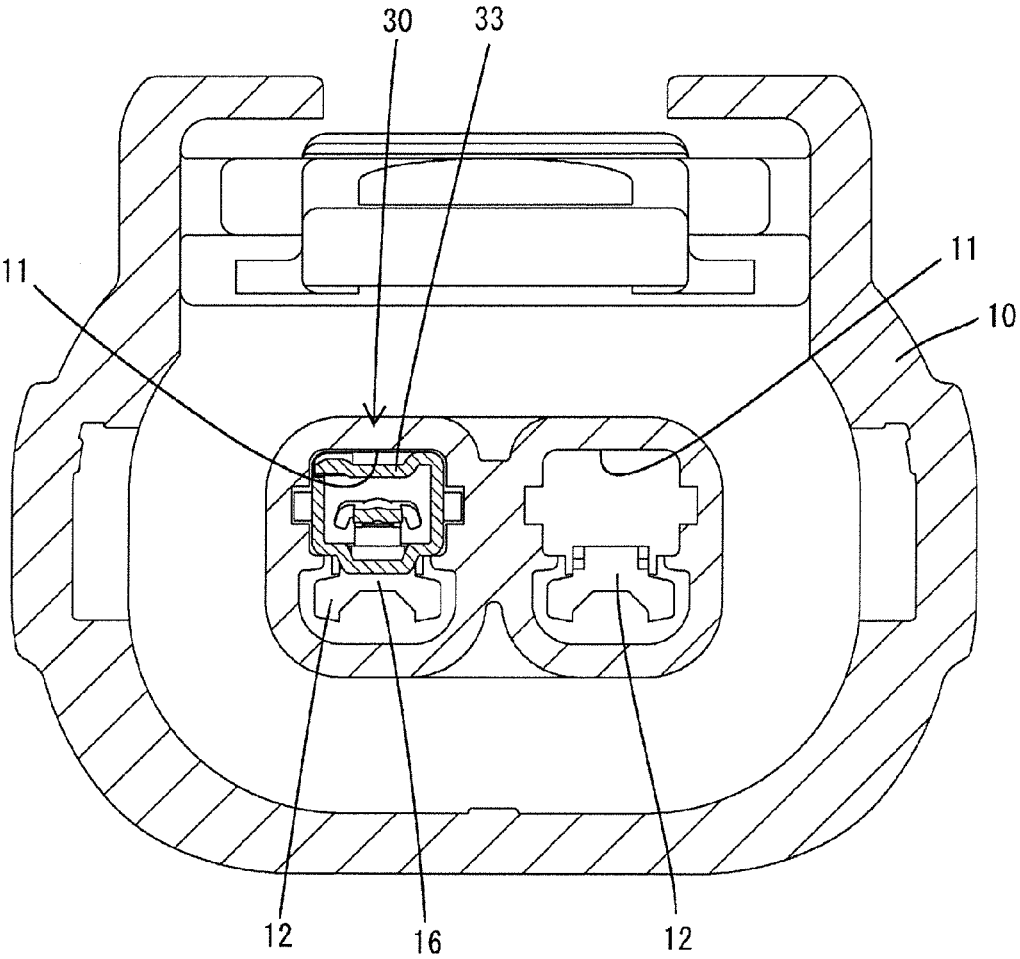
FIG. 1 is a front view in section of a connector of one embodiment.

An embodiment of the invention is described with reference to FIGS. 1 to 8. A connector of this embodiment includes a housing 10 made of synthetic resin and terminal fittings 30 to be mounted by being inserted into the housing 10 from behind. Note that, in the following description, a left side in FIGS. 2, 4 and 6 to 8 is defined as a front side concerning a front-back direction. A vertical direction is based on that shown in FIGS. 1 to 7 and a lateral direction is based on that shown in FIGS. 1, 3 and 5.

Terminal accommodating chambers 11 long and narrow in the front-back direction are formed in the housing 10. The terminal fitting 30 is inserted into the terminal accommodating chamber 11 from behind the housing 10. The housing 10 is integrally formed with locking lances 12 cantilevered forward along lower wall surfaces (inner walls) of the terminal accommodating chambers 11. The locking lance 12 is resiliently deflectable in the vertical direction (direction substantially perpendicular to an inserting direction of the terminal fitting 30 into the terminal accommodating chamber 11) with a rear or base end part thereof as a support. Note that the shape, the positional relationship and the like of the locking lance 12 are described below based on a free state where the locking lance 12 is not resiliently deflected (see FIG. 4).

The upper surface of the locking lance 12, i.e. a facing surface 13 vertically facing the terminal fitting 30 inserted into the terminal accommodating chamber 11, is composed of a horizontal surface 14 extending from the front end of the locking lance 12 to a substantially center position in the front-back direction and an inclined surface 15 extending from the rear end of the horizontal surface 14 to the rear end (base end) of the locking lance 12. The horizontal surface 14 is parallel to the inserting direction of the terminal fitting 30 into the terminal accommodating chamber 11. The inclined surface 15 is inclined down toward the back to be gradually separated from the terminal fitting 30.

Figure 3:
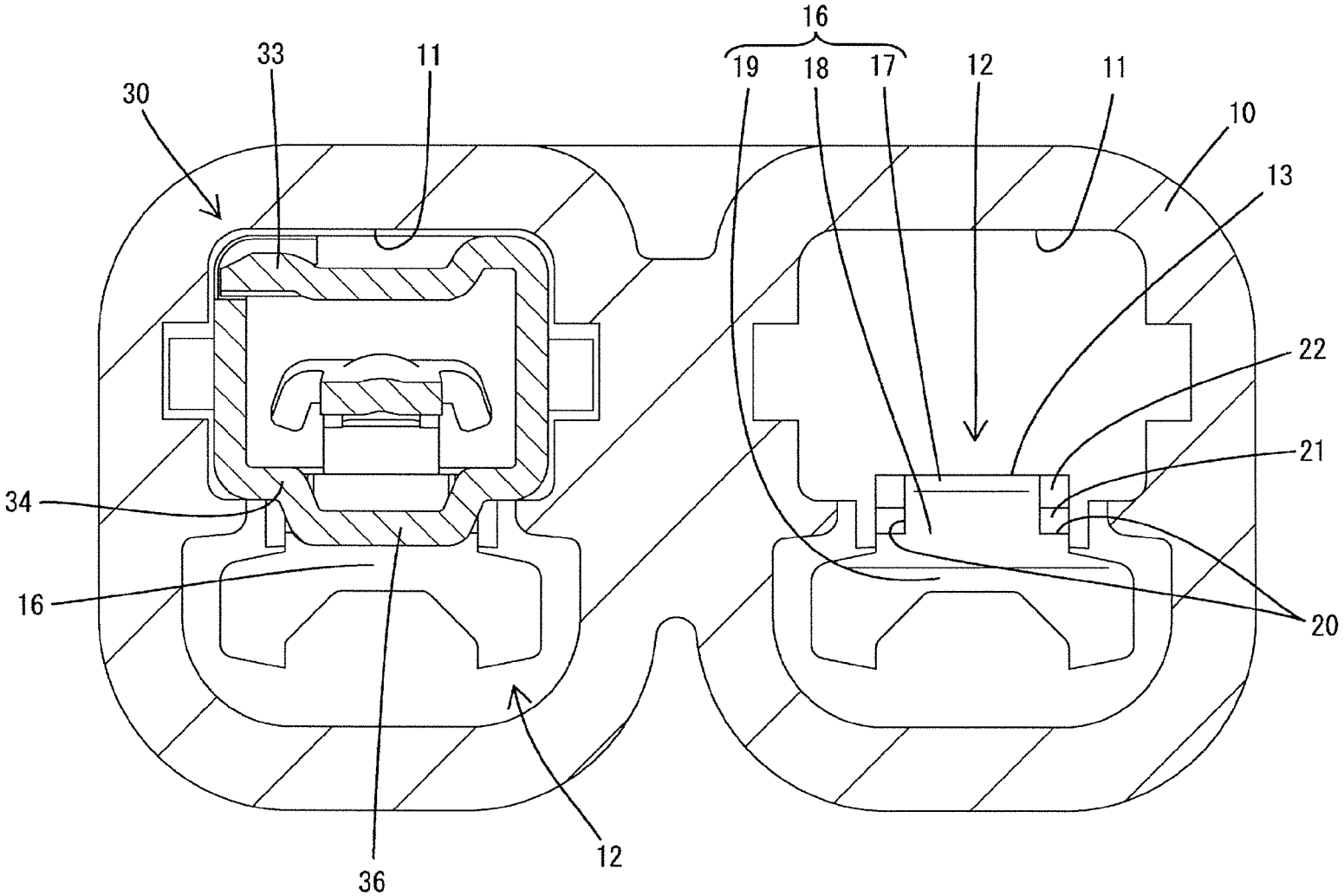
FIG. 3 is a partial enlarged front view in section showing a state where a terminal fitting is properly inserted.
Figure 4:
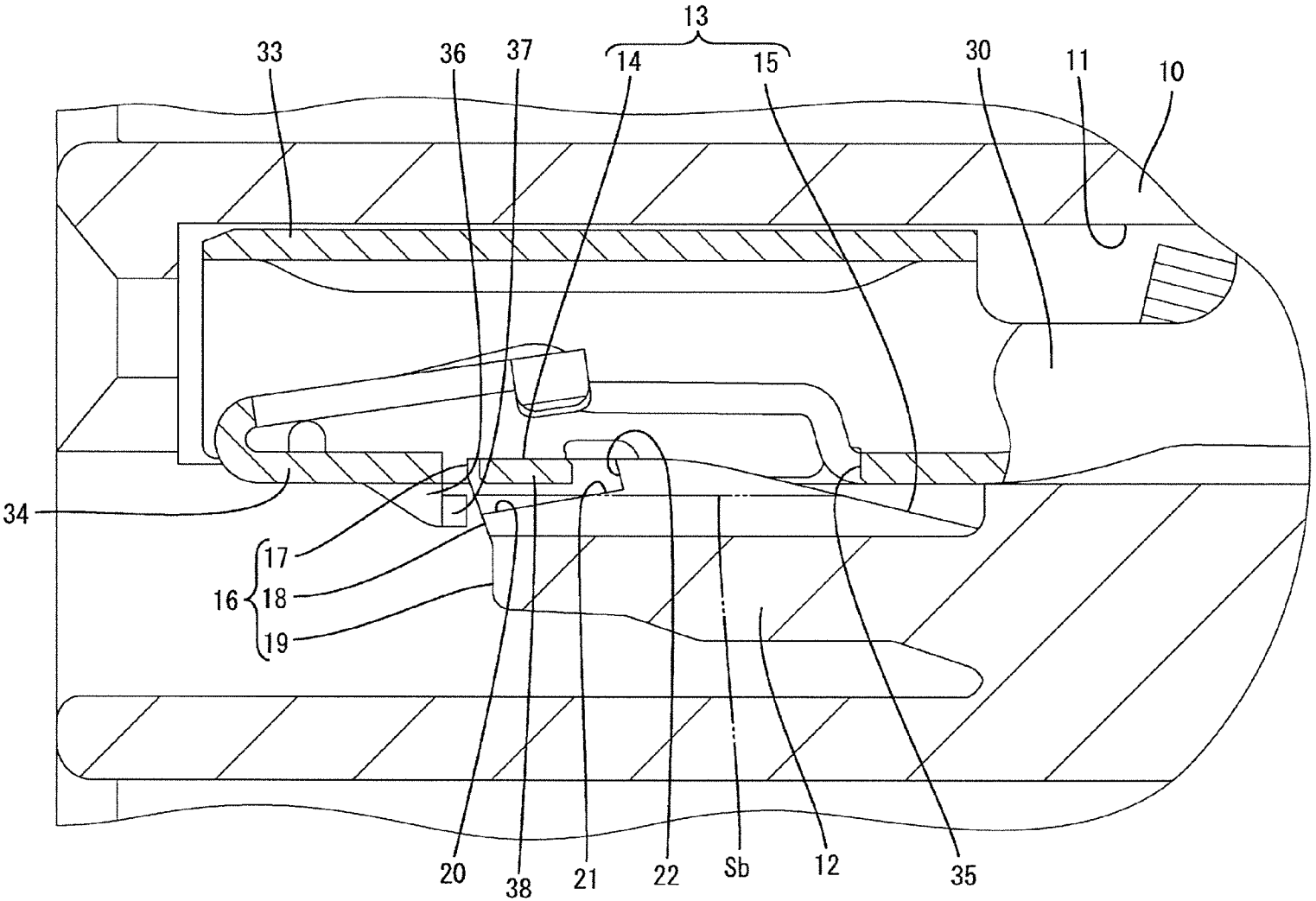
FIG. 4 is a partial enlarged side view in section showing the state where the terminal fitting is properly inserted.
Figure 5:
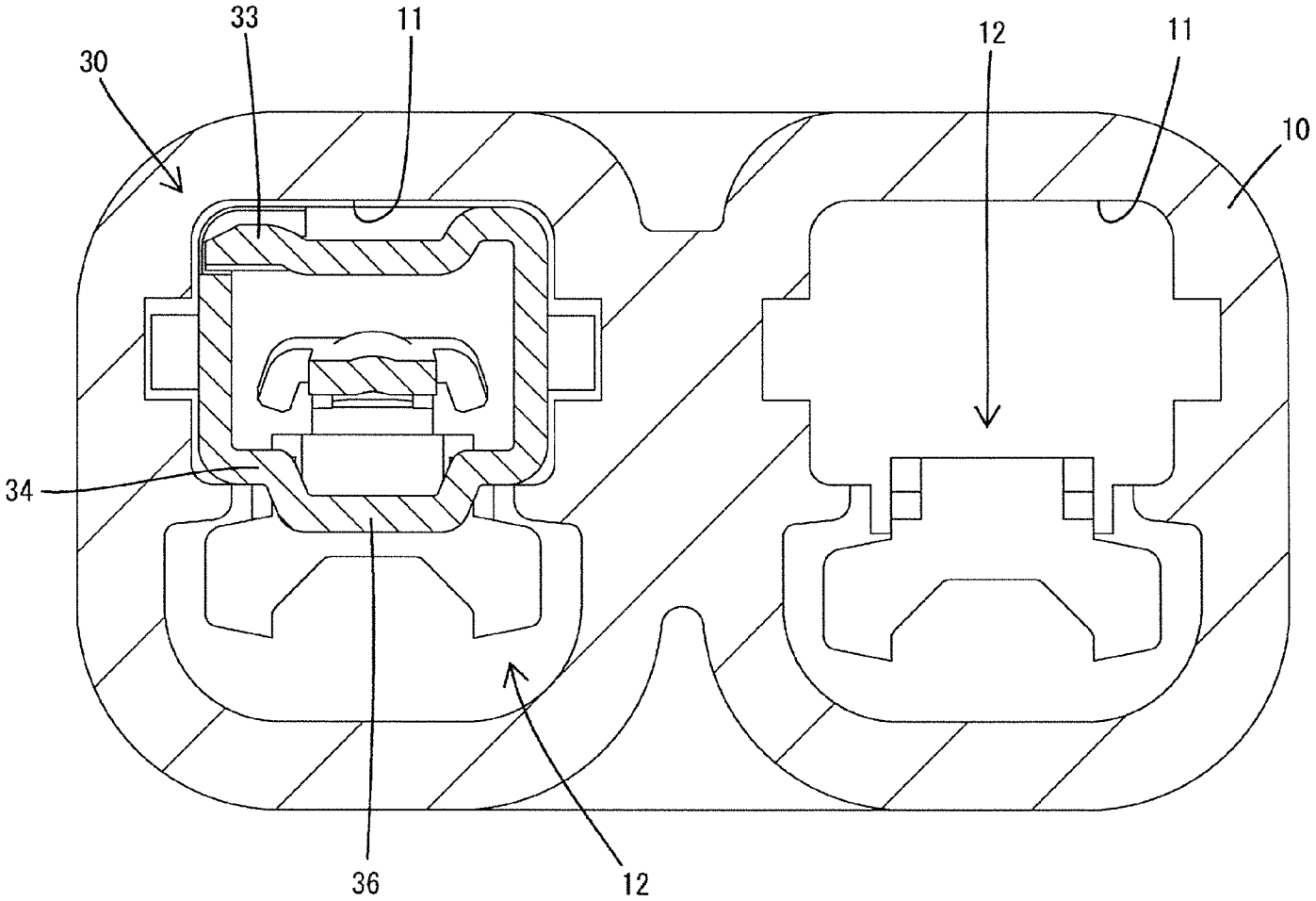
FIG. 5 is a front view in section showing a state where a locking portion presses a guiding surface and a locking lance is resiliently deflected upwardly.

The front end surface (extending end surface) of the locking lance 12 serves as a pressure receiving surface 16 that intersects substantially perpendicularly with the inserting direction of the terminal fitting 30 and faces or comes into contact with a locking portion 36 of the terminal fitting 30 to be described later in the front-back direction. As shown in FIGS. 3 and 4, the pressure receiving surface 16 is composed of a first vertical surface 17 connected perpendicularly to the front end edge of the horizontal surface 14 of the locking lance 12, an overhanging guide surface 18 connected to extend down from the lower end edge of the first vertical surface 17 and a second vertical surface 19 parallel to the first vertical surface 17 and connected to extend down from the lower end edge of the guide surface 18. The first vertical surface 17, the guide surface 18 and the second vertical surface 19 are arranged one above another along a resilient deflecting direction of the locking lance 12. In a state where the terminal fitting 30 is inserted properly in the terminal accommodating chamber 11, the locking portion 36 of the terminal fitting 30 is in contact with or facing the guide surface 18 of the pressure receiving surface 16.

As shown in FIG. 4, the guide surface 18 obliquely faces a lower front side. Thus, when a pressing force is applied to the guide surface 18 from the front, a force is caused to act to deflect the locking lance 12 resiliently up toward the terminal fitting 30 by the inclination of the guide surface 18. Further, in the vertical direction, a formation region of the guide surface 18 is within a range of a formation region of the inclined surface 15. That is, the uppermost end of the guide surface 18 is located at a height slightly lower than that of the inclined surface 15 and the lowermost end of the guide surface 18 is located at the same height as that of the inclined surface 15.

Accordingly, a virtual horizontal surface extending horizontally backward (i.e. direction in which the terminal fitting 30 is withdrawn from the terminal accommodating chamber 11) from the guiding surface 18 never fails to reach the inclined surface 15 if the height thereof is within a formation range of the guiding surface 18. If a pressing force acts on the guiding surface 18 from the front, a shear force is generated in the locking lance 12 along a virtual horizontal surface at a height where the pressing force is received. In this embodiment, a cross-section when the locking lance 12 is virtually cut along this virtual horizontal surface is defined as a "shear cross-section" and a cross-sectional area of this horizontal shear cross-section is defined as a "shear area".

The shear area becomes smaller as the height of the shear surface (virtual horizontal surface) approaches the upper end of the guiding surface 18 and becomes larger as the height of the shear surface approaches the lower end of the guiding surface 18. The fracture strength of the locking lance 12 when a pressing force acts on the guiding surface 18 becomes higher as the shear surface becomes larger. That the fracture strength of the locking lance 12 is high means that a holding force of the locking lance 12 for holding the terminal fitting 30 in a retained state is strong.

As shown in FIG. 3, the locking lance 12 is formed with a pair of bilaterally symmetrical cut portions 20 recessed down from the facing surface 13 in a stepped manner. The cut portions 20 are open on the front end surface (pressure receiving surface 16) and opposite left and right outer side surfaces of the locking lance 12. The side surface of the cut portion 20 is a flat surface perpendicular to both the inserting direction of the terminal fitting 30 (front-back direction) and the resilient deflecting direction of the locking lance 12 (vertical direction). As shown in FIG. 4, the bottom surface of the cut portion 20 serves as a contact surface 21 inclined down toward the front. The contact surface 21 is facing upward, i.e. in a direction facing the terminal fitting 30. Further, the rear surface of the cut portion 20 serves as a stopper 22 facing forward.

A formation region of the cut portion 20 (contact surface 21) in the front-back direction is a region before the inclined surface 15. That is, the cut portion 20 and the contact surface 21 are formed in a range from the front end of the locking lance 12 to a position before the rear end of the horizontal surface 14. Further, a formation region of the cut portion 20 (stopper 22) in the vertical direction corresponds to the entirety of the first vertical surface 17 and an upper end region of the guiding surface 18. That is, the cut portion 20 and the stopper 22 are formed in a range from the upper surface of the locking lance 12 (horizontal surface 14) to a position slightly above the lower end of the guiding surface 18.

Figure 2:
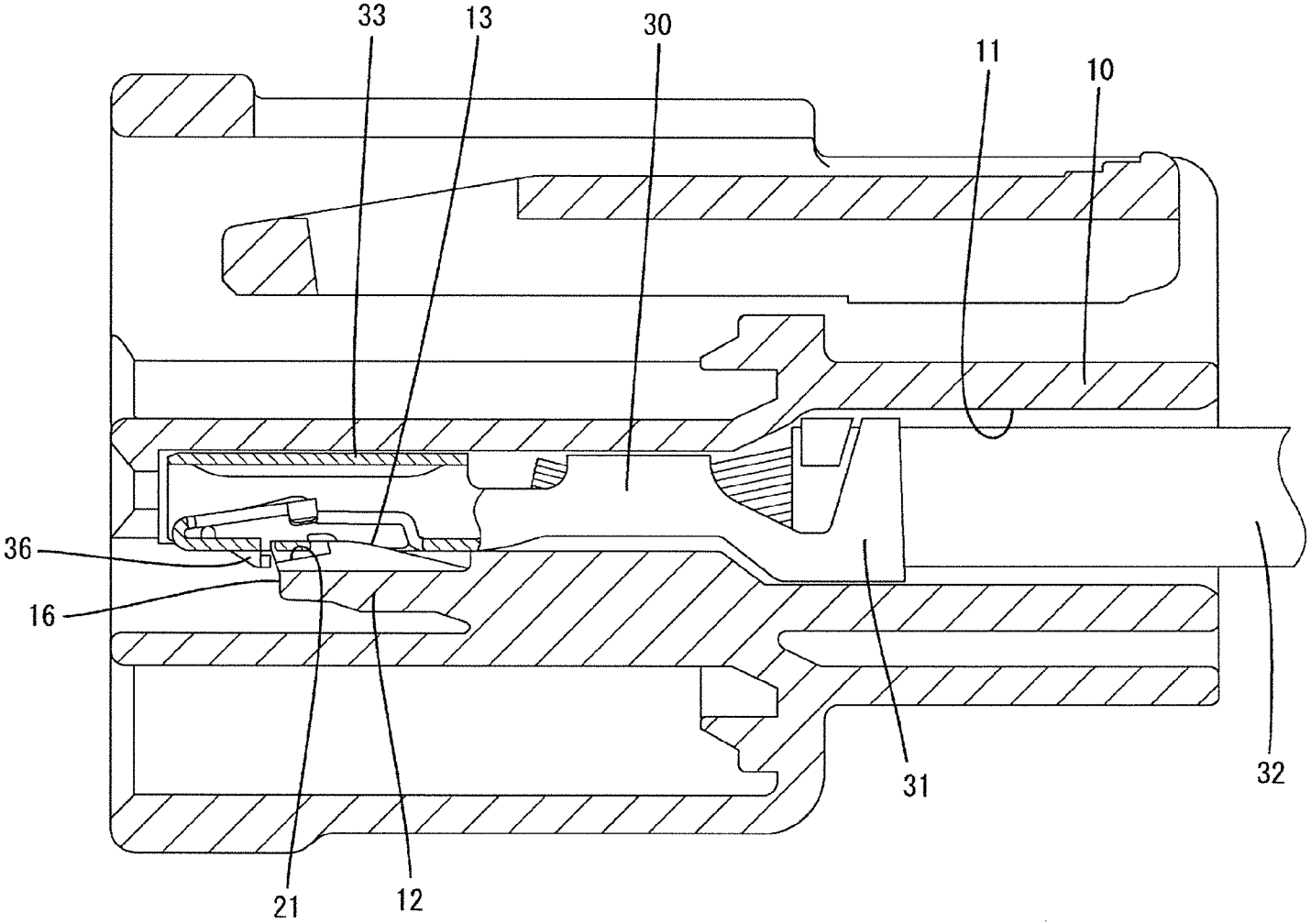
FIG. 2 is a side view in section of the connector.

The terminal fitting 30 is formed into a shape that is long and narrow in the front-back direction, such as by applying bending to a metal plate material having a predetermined shape. The terminal fitting 30 is inserted into the terminal accommodating chamber 11 from behind the housing 10 and held while being prevented from coming out backward by a locking action of the locking lance 12. As shown in FIG. 2, a crimping portion 31 in the form of an open barrel is formed on a rear end part of the terminal fitting 30 and a front end part of a wire 32 is connected to this crimping portion 31.

Figure 8:
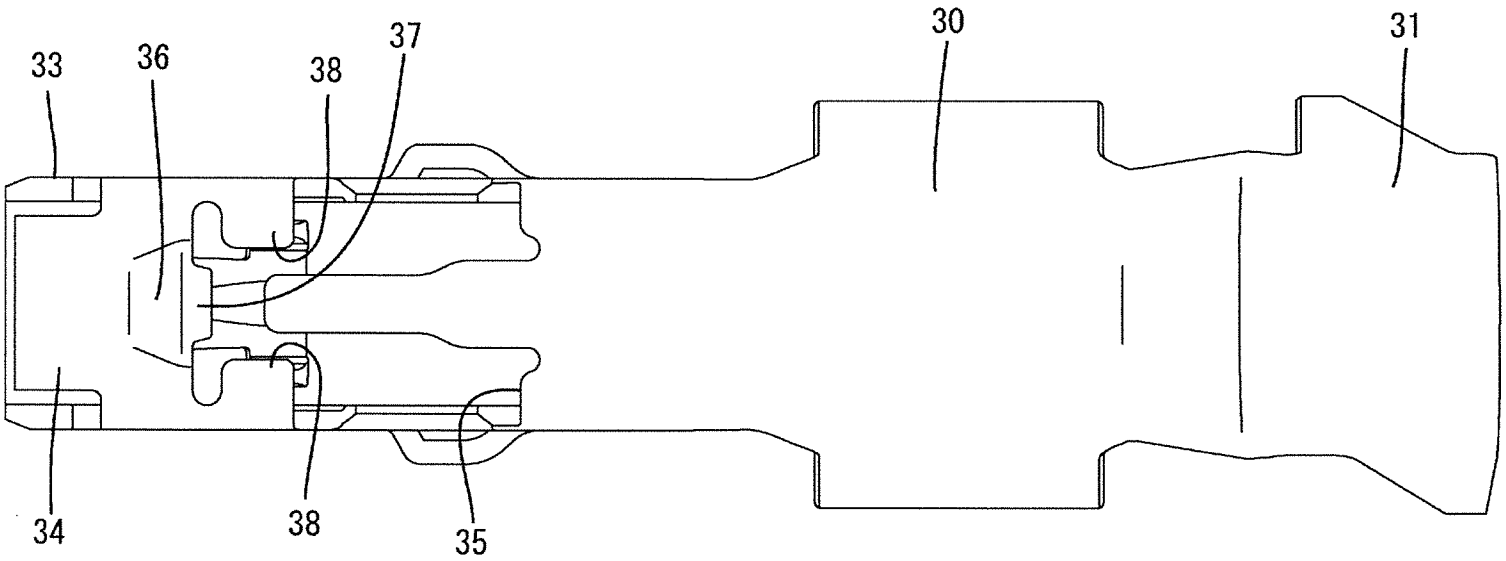
FIG. 8 is a bottom view of the terminal fitting.

A rectangular tube 33 is formed on a front end part of the terminal fitting 30. As shown in FIGS. 4 and 8, a locking hole 35 is formed on a bottom wall portion 34 constituting the rectangular tube 33. The locking hole 35 is located to correspond to the locking lance 12 in a state where the terminal fitting 30 is properly inserted in the terminal accommodating chamber 11. Further, the locking portion 36 is formed on the bottom wall portion 34 to extend along the front end edge of the opening edge of the locking hole 35. A substantially trapezoidal region of the bottom wall portion 34 before the locking hole 35 is struck to protrude down, thereby forming the locking portion 36. A horizontal rear edge part of the locking portion 36 serves as a pressing edge 37 to be brought into contact with the locking lance 12. This pressing edge 37 is located below the bottom wall portion 34 (i.e. closer to the locking lance 12). In the lateral direction, the locking portion 36 and the pressing edge 37 are located in the center of the rectangular tube 33 (bottom wall portion 34).

As shown in FIG. 8, the bottom wall portion 34 is formed with a pair of bilaterally symmetrical deflection regulating portions 38. The deflection regulating portions 38 are substantially rectangular pieces bulging in from opposite left and right side edge parts of the opening edge of the locking hole 35. The deflection regulating portions 38 are continuous and flush with the bottom wall portion 34. Thus, as shown in FIG. 4, the pressing edge 37 is located below the deflection regulating portions 38. In the front-back direction, the deflection regulating portions 38 are arranged slightly behind the pressing edge 37. Further, as shown in FIG. 8, the deflection regulating portions 38 are arranged at positions farther laterally outward of opposite left and right ends of the pressing edge 37.

In a state before the terminal fitting 30 is inserted into the terminal accommodating chamber 11, the locking lance 12 is kept in a free state free from resilient deflection due to its own rigidity. In the process of inserting the terminal fitting 30, the front end of the bottom wall portion 34 of the rectangular tube 33 or the locking portion 36 comes into contact with the inclined surface 15 of the locking lance 12. Therefore the locking lance 12 is deflected resiliently down. In the process of further inserting the terminal fitting 30 from this state, the bottom wall portion 34 or the locking portion 36 slides in contact with the inclined surface 15 and the horizontal surface 14.

When the terminal fitting 30 reaches a proper insertion position, the pressing edge 37 of the locking portion 36 passes through the front end of the locking lance 12. Thus, the locking lance 12 resiliently returns upward to the free state due to its resilient restoring force. In this state, as shown in FIG. 4, the horizontal surface 14 of the locking lance 12 is located above the pressing edge 37 and the pressing edge 37 is facing an upper end part of the guiding surface 18 while defining a small clearance in the front-back direction.

Further, when the locking lance 12 resiliently returns to the free state, an upper end part of the locking lance 12 enters the locking hole 35 and a part of the locking lance 12 between the left and right cut portions 20 is located to be held in a non-contact state between the pair of left and right deflection regulating portions 38. At this time, the deflection regulating portions 38 and the contact surfaces 21 are not in contact. That is, the lower surfaces of the deflection regulating portions 38 are located to vertically face the contact surfaces 21 while defining a predetermined space. Further, the rear ends of the deflection regulating portions 38 are facing the stoppers 22 of the locking lance 12 in the front-back direction while defining a small clearance (i.e. in a non-contact state).

If a backward tensile force acts on the terminal fitting 30 in this state, the pressing edge 37 comes into contact with the upper end part of the guiding surface 18 and the locking lance 12 locks the terminal fitting 30 from behind while being hardly resiliently deflected when the terminal fitting 30 is displaced slightly back. By this locking action of the locking lance 12, the terminal fitting 30 is held in the retained state. At this time, the shear area of the shear surface extending backward from a contact position of the guiding surface 18 with the pressing edge 37 is relatively small, but the terminal fitting 30 is held in the retained state if the tensile force acting on the terminal fitting 30 is small.

Figure 6:
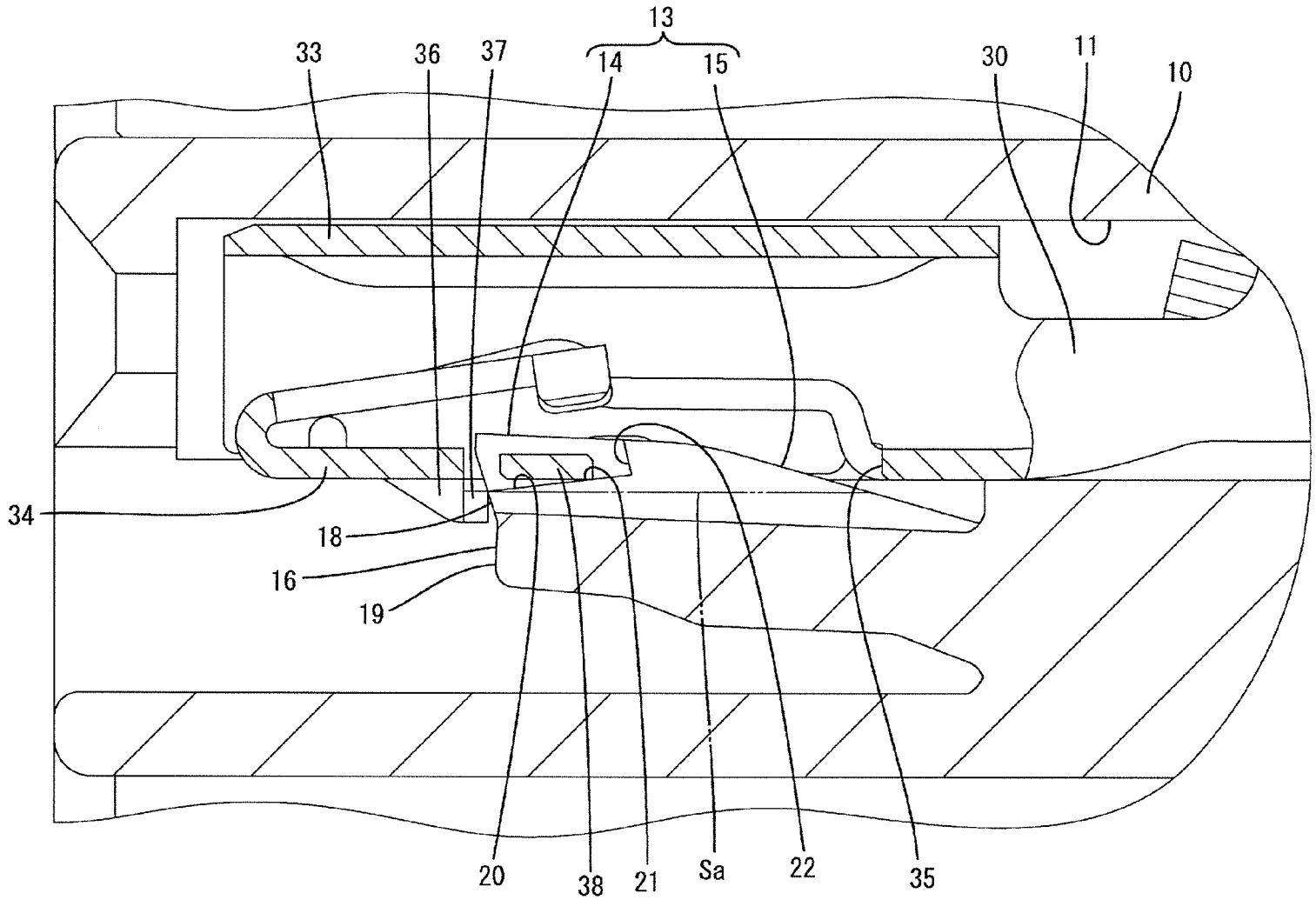
FIG. 6 is a side view in section showing the state where the locking portion presses the guiding surface and the locking lance is resiliently deflected upwardly.

However, if the tensile force acting on the terminal fitting 30 is strong, a pressing force acting on the guiding surface 18 from the front from the pressing edge 37 is also strong. Thus, the locking lance 12 is deflected resiliently up toward the terminal fitting 30 by the inclination of the guiding surface 18. Upward displacement of the locking lance 12 is obstructed when the contact surfaces 21 come into contact with the deflection regulating portions 38 from below, as shown in FIG. 6. In this state, the contact position of the guiding surface 18 with the pressing edge 37 is displaced down. At this time, a shear area of a shear surface Sa (see FIG. 6) extending backward (direction parallel to a tensile direction acting on the terminal fitting 30) from a lower end part of the guiding surface 18 is larger than that of a shear surface Sb (see FIG. 4) on the upper end part of the guiding surface 18. Thus, the shear strength of the locking lance 12, i.e. the holding force for holding the terminal fitting 30 in the retained state is enhanced.

The guiding surface 18, as the front end surface of the locking lance 12, is obliquely facing the lower front side even in such a state where the locking lance 12 is deflected resiliently up. Thus, if the tensile force acting on the terminal fitting 30 is strengthened further, the locking lance 12 may be buckled and deformed by the pressing force from the pressing edge 37 sufficiently that the upper surface thereof (facing surface 13 facing the terminal fitting 30) bulges upwardly (toward the terminal fitting 30). However, the contact surfaces 21 are arranged at positions behind the guiding surface 18 (base end side of the locking lance 12) and the deflection regulating portions 38 of the terminal fitting 30 are in contact with these contact surfaces 21 from above in this embodiment. Thus, the locking lance 12 is neither buckled nor deformed to bulge upwardly.

Figure 7:
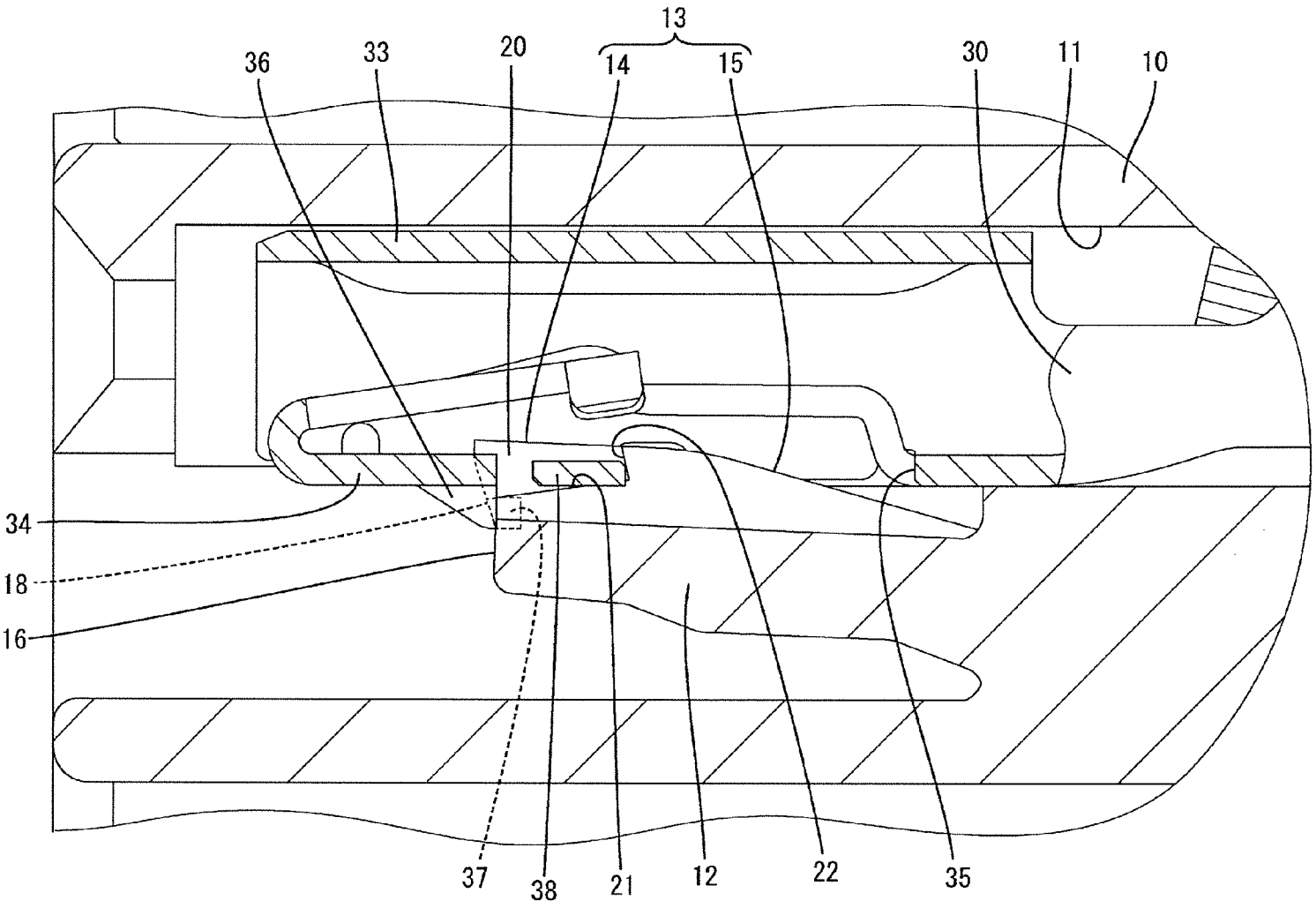
FIG. 7 is a side view in section showing a state where the locking portion bites in the guide surface and a deflection regulating portion is in contact with a stopper.

As just described, the locking lance 12 is prevented from being buckled and deformed. More particularly, the pressing edge 37 bites into the guiding surface 18 while the terminal fitting 30 is displaced slightly back, as shown in FIG. 7, when the tensile force acting on the terminal fitting 30 becomes strong. The rear ends of the deflection regulating portions 38 come into contact with the stoppers 22 of the locking lance 12 from the front. Then, any further backward displacement of the terminal fitting 30 and the biting of the pressing edge 37 into the guiding surface 18 are regulated by the contact of the deflection regulating portions 38 with the stoppers 22.

As described above, the pressure receiving surface 16 is formed on the front end surface of the locking lance 12 and the terminal fitting 30 is formed with the locking portion 36 for retaining the terminal fitting 30 by locking the pressure receiving surface 16 from the front. When the locking portion 36 presses the pressure receiving surface 16, the guiding surface 18 formed on the pressure receiving surface 16 causes the locking lance 12 to be deflected in the direction toward the terminal fitting 30. Further, the facing surface 13 of the locking lance 12 facing the terminal fitting 30 is formed with the inclined surface 15 inclined to be separated more from the terminal fitting 30 toward the back, and the contact surfaces 21 facing the terminal fitting 30 are formed at the positions of the locking lance 12 behind the pressure receiving surface 16. On the other hand, the terminal fitting 30 is formed with the deflection regulating portions 38 located behind the locking portion 36 and facing the contact surfaces 21 while being spaced apart in the vertical direction substantially parallel to the resilient deflecting direction of the locking lance 12 when the locking lance 12 is in the free state free from resilient deflection.

According to this configuration, when a pressing force of the locking portion 36 acts on the front end surface (pressure receiving surface 16) of the locking lance 12 from front, the buckling of the locking lance 12 is prevented by the contact of the deflection regulating portions 38 and the contact surfaces 21 even if the locking lance 12 is going to be buckled and deformed upward between the base end (rear end) and the extending end (front end) thereof. Thus, according to this embodiment, there is no possibility of losing the holding force by the locking lance 12 due to the buckling deformation of the locking lance 12. Therefore the reliability of a function of holding the terminal fitting 30 by the locking lance 12 is excellent.

When the pressing edge portion 37 of the locking portion 36 bites into the guiding surface 18 of the pressure receiving surface 16, the deflection regulating portions 38 come into contact with the stoppers 22 from the front to regulate a backward relative displacement of the terminal fitting 30 with respect to the locking lance 12. Thus, excessive biting of the locking portion 36 into the pressure receiving surface 16 is prevented.

A locking margin between the locking portion 36 (pressing edge 37) and the pressure receiving surface 16 (guiding surface 18) in the resilient deflecting direction of the locking lance 12 (vertical direction) is equivalent to a distance from the facing surface 13 of the locking lance 12 facing the terminal fitting 30 to the pressing edge 37. If the contact surfaces 21 are set on the facing surface 13 of the locking lance 12 facing the terminal fitting 30, a height difference between the deflection regulating portions 38 and the pressing edge 37 is large. This complicates the shape of the terminal fitting 30. In view of this point, in this embodiment, the locking lance 12 is formed with the cut portions 20 recessed from the facing surface 13 facing the terminal fitting 30 and the surfaces of the cut portions 20 facing the terminal fittings 30 serve as the contact surfaces 21. Since the height difference between the deflection regulating portions 38 and the locking portion 36 is reduced in this way, the shape of the terminal fitting 30 is simplified.

Further, the pair of contact surfaces 21 and the pair of deflection regulating portions 38 are bilaterally symmetrically arranged in a width direction intersecting with both the resilient deflecting direction of the locking lance 12 (vertical direction) and the inserting direction of the terminal fitting 30 (front-back direction). According to this configuration, the posture of the locking lance 12 is not laterally inclined when the contact surfaces 21 come into contact with the deflection regulating portions 38, wherefore the function of holding the terminal fitting 30 by the locking lance 12 is stabilized.

Further, the pair of the deflection regulating portions 38 and the pair of the stoppers 22 are bilaterally symmetrically arranged in the width direction intersecting with both the resilient deflecting direction of the locking lance 12 and the inserting direction of the terminal fitting 30. According to this configuration, the posture of the locking lance 12 is not laterally changed when the deflection regulating portions 38 come into contact with the stoppers 22, wherefore the function of holding the terminal fitting 30 by the locking lance 12 is stabilized.

The invention is not limited to the above described and illustrated embodiment. For example, the following embodiments also are included in the scope of the invention.

Although the deflection regulating portions and the contact surfaces vertically come into contact only in narrow regions on the rear end parts thereof in the above embodiment, the deflection regulating portions and the contact surfaces may come into surface contact over wide ranges in the front-back direction.

Although the stoppers for regulating a backward relative displacement of the terminal fitting with respect to the locking lance when the locking portion bites into the pressure receiving surface are provided in the above embodiment, such stoppers may not be provided.

Although the pair of contact surfaces and the pair of deflection regulating portions are bilaterally symmetrical in the above embodiment, at least one of the pair of contact surfaces and the pair of the deflection regulating portions may be bilaterally asymmetrical.

Although the pair of contact surfaces and the pair of deflection regulating portions are provided in the above embodiment, one contact surface and one deflection regulating portion may be provided.

Although the pair of deflection regulating portions and the pair of stoppers are bilaterally symmetrical in the above embodiment, at least one of the pair of deflection regulating portions and the pair of stoppers may be bilaterally asymmetrical.

Although the pair of deflection regulating portions and the pair of stoppers are provided in the above embodiment, one deflection regulating portion and one stopper may be provided.

Although the facing surface of the locking lance facing the terminal fitting (surface as a reference of the locking margin between the locking portion and the pressure receiving surface in the resilient deflecting direction of the locking lance) is recessed to form the cut portions and the contact surfaces are provided in these cut portions in the above embodiment, the contact surfaces may be arranged on the facing surface of the locking lance facing the terminal fitting as a reference of the locking margin between the locking portion and the pressure receiving surface in the resilient deflecting direction of the locking lance without forming the cut portions on the facing surface.

Although the contact surfaces are inclined downwardly toward the front in the inserting direction of the terminal fitting when the locking lance is in the free state free from resilient deflection in the above embodiment, the contact surfaces may be surfaces parallel to the inserting direction of the terminal fitting when the locking lance is in the free state.

Although the guiding surface is formed only on the pressure receiving surface of the locking lance in the above embodiment, it may be formed only on the locking portion (pressing edge portion) of the terminal fitting or may be formed on both the pressure receiving surface and the locking portion.

LIST OF REFERENCE SIGNS

10 . . . housing
11 . . . terminal accommodating chamber
12 . . . locking lance
13 . . . facing surface
15 . . . inclined surface
16 . . . pressure receiving surface
18 . . . guiding surface
20 . . . cut portion
21 . . . contact surface
22 . . . stopper
30 . . . terminal fitting
36 . . . locking portion
38 . . . deflection regulating portion

The invention claimed is:

1. A connector, comprising:

a housing with opposite front and rear ends and internally formed with a terminal accommodating chamber;

a terminal fitting to be inserted into the terminal accommodating chamber from behind and along an inserting direction, a rearward facing locking portion formed on the terminal fitting, and a deflection regulating portion formed at a position on the terminal fitting behind the locking portion;

a locking lance made of synthetic resin and cantilevered forward along an inner wall of the terminal accommodating chamber, the locking lance being configured to be contacted by the terminal fitting when inserting the terminal fitting into the terminal accommodating chamber so that the locking lance is deflected resiliently in a resilient deflecting direction intersecting the inserting direction, the locking lance further being configured to return resiliently to a free state when the terminal fitting is inserted properly into the terminal accommodating chamber, the locking lance including:

a pressure receiving surface formed on a front end surface of the locking lance and configured to retain the terminal fitting by locking the locking portion of the terminal fitting from behind;

an inclined surface formed on a facing surface of the locking lance facing the terminal fitting and inclined to be more separated from the terminal fitting toward back;

a contact surface formed at a position of the locking lance behind the pressure receiving surface and facing the terminal fitting; and a stopper configured to regulate a backward relative displacement of the terminal fitting with respect to the locking lance by contacting the deflection regulating portion with the stopper from the front when the locking portion bites into the pressure receiving surface; and the connector further comprising:

a guiding surface formed on at least one of the pressure receiving surface and the locking portion and configured to deflect the locking lance in a direction toward the terminal fitting when the locking portion presses the pressure receiving surface, wherein the deflection regulating portion is configured to face the contact surface while being spaced apart in a direction substantially parallel to a resilient deflecting direction of the locking lance when the locking lance is in the free state free from resilient deflection.

2. The connector of claim 1, wherein a pair of the deflection regulating portions and a pair of the stoppers are provided bilaterally symmetrically in a width direction intersecting with both the resilient deflecting direction of the locking lance and the inserting direction of the terminal fitting.

3. The connector of claim 2, further comprising a cut portion recessed from the facing surface of the locking lance facing the terminal fitting and configured such that a surface of a recessed region facing the terminal fitting defines the contact surface.

4. The connector of claim 3, wherein a pair of the contact surfaces and a pair of the deflection regulating portions are provided bilaterally symmetrically in a width direction intersecting with both the resilient deflecting direction of the locking lance and the inserting direction of the terminal fitting.

5. A connector comprising:

a housing with opposite front and rear ends and internally formed with a terminal accommodating chamber;

a terminal fitting to be inserted into the terminal accommodating chamber from behind and along an inserting direction, a rearward facing locking portion formed on the terminal fitting, and a deflection regulating portion formed at a position on the terminal fitting behind the locking portion;

a locking lance made of synthetic resin and cantilevered forward along an inner wall of the terminal accommodating chamber, the locking lance being configured to be contacted by the terminal fitting when inserting the terminal fitting into the terminal accommodating chamber so that the locking lance is deflected resiliently in a resilient deflecting direction that intersects the inserting direction, the locking lance further being configured to return resiliently to a free state when the terminal fitting is inserted properly into the terminal accommodating chamber, the locking lance including:

a pressure receiving surface on a front end of the locking lance and configured to retain the terminal fitting by locking the locking portion of the terminal fitting from behind;

a facing surface formed on an area of the locking lance facing the terminal accommodating chamber, the facing surface including an inclined surface aligned to be separated more from the terminal fitting at more rearward positions on the locking lance; and a cut portion recessed from the facing surface of the locking lance facing the terminal fitting and configured such that a surface of a recessed region facing the terminal fitting defines a contact surface at a position of the locking lance behind the pressure receiving surface and facing the terminal fitting, wherein the contact surface faces the deflection regulating portion while being spaced apart in a direction substantially parallel to a resilient deflecting direction of the locking lance when the locking lance is in the free state free from resilient deflection; and the connector further including a guiding surface formed on at least one of the pressure receiving surface of the locking lance and the locking portion of the terminal fitting, the guiding surface being configured to deflect the locking lance in a direction toward the terminal fitting when the locking portion presses the pressure receiving surface rearward.

6. A connector, comprising:

a housing with opposite front and rear ends and internally formed with a terminal accommodating chamber;

a terminal fitting to be inserted into the terminal accommodating chamber from behind and along an inserting direction, a rearward facing locking portion formed on the terminal fitting, two deflection regulating portions formed at a position on the terminal fitting behind the locking portion;

a locking lance made of synthetic resin and cantilevered forward along an inner wall of the terminal accommodating chamber, the locking lance being configured to be contacted by the terminal fitting when inserting the terminal fitting into the terminal accommodating chamber so that the locking lance is deflected resiliently in a resilient deflecting direction that intersects the inserting direction, the locking lance further being configured to return resiliently to a free state when the terminal fitting is inserted properly into the terminal accommodating chamber, the locking lance including:

a pressure receiving surface on a front end of the locking lance and configured to retain the terminal fitting by locking the locking portion of the terminal fitting from behind;

a facing surface formed on an area of the locking lance facing the terminal accommodating chamber, the facing surface including an inclined surface aligned to be separated more from the terminal fitting at more rearward positions on the locking lance; and two contact surfaces formed at a position of the locking lance behind the pressure receiving surface and facing the terminal fitting; and the connector further comprising:

a guiding surface formed on at least one of the pressure receiving surface of the locking lance and the locking portion of the terminal fitting, the guiding surface being configured to deflect the locking lance in a direction toward the terminal fitting when the locking portion presses the pressure receiving surface rearward, wherein the two contact surfaces are formed at a position of the locking lance behind the pressure receiving surface and facing the terminal fitting and the two deflection regulating portions are provided bilaterally symmetrically in a width direction intersecting both the resilient deflecting direction of the locking lance and the inserting direction of the terminal fitting.

* * * * *